US008484979B2

(12) United States Patent
Lam

(10) Patent No.: US 8,484,979 B2
(45) Date of Patent: Jul. 16, 2013

(54) BURNER FUEL STAGING

(75) Inventor: Kam-Kei Lam, Bracebridge Heath (GB)

(73) Assignee: Siemens Aktiengesellschaft, München (DE)

( * ) Notice: Subject to any disclaimer, the term of this patent is extended or adjusted under 35 U.S.C. 154(b) by 974 days.

(21) Appl. No.: 12/531,351

(22) PCT Filed: Mar. 11, 2008

(86) PCT No.: PCT/EP2008/052875

§ 371 (c)(1),
(2), (4) Date: Sep. 15, 2009

(87) PCT Pub. No.: WO2008/110554

PCT Pub. Date: Sep. 18, 2008

(65) Prior Publication Data

US 2010/0064692 A1 Mar. 18, 2010

(30) Foreign Application Priority Data

Mar. 15, 2007 (EP) ..... 07005408

(51) Int. Cl.
*F02C 1/00* (2006.01)

(52) U.S. Cl.
USPC ..... 60/748; 60/737

(58) Field of Classification Search
USPC .... 60/734, 737–740, 742, 746, 748; 431/354; 239/399
See application file for complete search history.

(56) References Cited

U.S. PATENT DOCUMENTS

| | | | | |
|---|---|---|---|---|
| 4,027,473 | A * | 6/1977 | Baker | 60/39.281 |
| 4,817,389 | A * | 4/1989 | Holladay et al. | 60/739 |
| 5,036,657 | A * | 8/1991 | Seto et al. | 60/39.281 |
| 5,235,814 | A * | 8/1993 | Leonard | 60/738 |
| 5,311,742 | A | 5/1994 | Izumi et al. | |
| 5,319,931 | A | 6/1994 | Beebe et al. | |
| 5,628,192 | A * | 5/1997 | Hayes-Bradley et al. | 60/733 |
| 6,418,725 | B1 * | 7/2002 | Maeda et al. | 60/776 |
| 6,532,726 | B2 * | 3/2003 | Norster et al. | 60/39.281 |
| 6,857,272 | B2 * | 2/2005 | Summerfield et al. | 60/739 |
| 6,915,640 | B2 * | 7/2005 | Jonsson | 60/776 |
| 7,665,309 | B2 * | 2/2010 | Parker et al. | 60/776 |
| 7,836,699 | B2 * | 11/2010 | Graves | 60/748 |
| 8,122,725 | B2 * | 2/2012 | Myers et al. | 60/776 |
| 2006/0257807 | A1 | 11/2006 | Hicks et al. | |

FOREIGN PATENT DOCUMENTS

| | | | |
|---|---|---|---|
| EP | 0399336 | A1 | 11/1990 |
| EP | 0592717 | B1 | 4/1994 |
| EP | 0974789 | B1 | 1/2000 |
| EP | 0976982 | B1 | 2/2000 |
| GB | 2242734 | A | 10/1991 |
| JP | 2006336995 | A | 12/2006 |

* cited by examiner

*Primary Examiner* — Phutthiwat Wongwian

(57) ABSTRACT

A fuel-air premixing arrangement includes a plurality of fuel injection openings. The fuel injection openings are grouped into at least two groups and arranged on one circle in alternating order. Each group has a common rail for supplying fuel to the respective group. A valve element is arranged in at least one common rail.

13 Claims, 5 Drawing Sheets

BURNER FUEL STAGING

CROSS REFERENCE TO RELATED APPLICATIONS

This application is the US National Stage of International Application No. PCT/EP2008/052875, filed Mar. 11, 2008 and claims the benefit thereof. The International Application claims the benefits of European application No. 07005408.5 filed Mar. 15, 2007 both of the applications are incorporated by reference herein in their entirety.

FIELD OF THE INVENTION

The invention relates to a burner and a method of operating a burner with staged fuel supply.

BACKGROUND OF THE INVENTION

In a burner of a gas turbine fuel is burnt to produce hot pressurized mainstream gases which are led to a turbine stage where they, while expanding and cooling, transfer momentum to turbine blades thereby imposing a rotational movement on a turbine rotor. Mechanical power of the turbine rotor can then be used to drive a generator for producing electrical power or to drive a machine. However, burning the fuel leads to a number of pollutants in the exhaust gas which can cause damage to the environment.

One method to reduce pollutants is to provide thorough mixing of fuel and air prior to combustion. Usually the premixing of fuel and air in a gas turbine engine takes place by injecting fuel into an air stream in a swirling zone of a combustor which is located upstream from the combustion zone. The swirling produces a mixing of fuel and air before the mixture enters the combustion zone. The design point of fuel injection systems for stationary gas turbine engines is usually close to full load conditions, where reasonably low NOx values are achieved.

However, for power output requirements different from the design point, the rate of formation of nitrous oxides may increase significantly. At relatively low power modes, such as at light-off for example or at other determined burner conditions, a relatively rich fuel/air ratio is desired for initiating combustion and maintaining stability of the combustion, which is achieved with a pilot fuel injection.

The present invention addresses premix fuel systems when operating the gas turbine engine at different loads.

EP 0 592 717 B1 describes a gas-operated premixing burner for the combustion chamber of, for example, a gas turbine in which, within a premixing space, the fuel injected by means of a plurality of nozzles is intensively mixed with the combustion air prior to ignition, the nozzles being arranged around a burner axis. Within the premixing space additional fuel nozzles are provided in the region of the burner axis, which fuel nozzles can be supplied via a separate fuel conduit, with the result that, in order to influence the fuel profile at the outlet from the premixing burner in a specific manner, the fuel concentration in the region of the burner axis is greater than the average fuel concentration in the outlet plane of the premixing burner. The separate fuel conduit is provided with a control valve which can be shut off.

EP 0 974 789 B1 describes a method of operating a gas turbine in which a liquid fuel is burned in a combustion chamber and the hot combustion gases produced in the process are directed through the gas turbine, and in which method the liquid fuel is fed to the combustion chamber via a plurality of controllable burners working in parallel and is sprayed into the combustion chamber via fuel nozzles, and the burners are divided into at least two groups of burners, and these groups are individually activated as a function of the operating state of the gas turbine.

EP 0 976 982 B1 describes a method of operating a gas turbine in which a gaseous fuel is sprayed via a plurality of burners, working in parallel and arranged on at least one concentric ring, into the combustion chamber and is burned there, and the hot combustion gases produced in the process are directed through the gas turbine, the burners are divided into at least two groups of burners, and these groups are activated individually as a function of the operating state of the gas turbine, the at least two groups, during the run-up of the gas turbine from the no-load idling operation to a full-load operation, being ignited and/or started up one after the other in at least two phases. At least one of the groups comprises the same burners as another group, the two groups differing only in the operating mode, of the burners, and the burners of the two groups being operated within a moderate load range in two operating modes.

GB 2 242 734 A describes a combustion assembly including a combustor having inner and outer liners, and pilot stage and main stage combustion means disposed between the liners. A turbine nozzle is joined to downstream ends of the combustor inner and outer liners and the main stage combustion means is close coupled to the turbine nozzle for obtaining short combustion residence time of main stage combustion gases for reducing NOx emissions. The combustion assembly includes first and second pluralities of circumferentially spaced fuel injectors for pilot stage and main stage combustion. Main injectors are for lean main injection only and pilot injectors are for rich pilot injection only.

SUMMARY OF THE INVENTION

An object of the invention is to provide an improved fuel-air premixing arrangement for operating a burner over various machine loads with low rate of formation of nitrous oxides and a method of operating such a fuel-air premixing arrangement.

This object is achieved by the independent claims. The dependent claims describe advantageous developments and modifications of the invention.

An inventive fuel-air premixing arrangement comprises a plurality of fuel injection openings, especially for a swirler of a gas turbine engine, divided into at least two groups and arranged on one circle in alternating order, wherein each group has a common rail. In at least one of the common rails a valve element is arranged to stage the premix fuel supply for an optimized fuel-air mixing quality over the complete gas turbine load range.

The fuel-air premixing arrangement can be operated in different modes. In a first advantageous, constant staging mode the valve element is an orifice implemented in at least one of the common rails. The implantation of an orifice regulation provides great operational flexibility benefits over using fuel injection openings with different opening diameters. An orifice is a robust solution that can be easily adapted to different ambient conditions, like winter and summer times or the use of different fuel to operate the burners. With an orifice, a constant staging ratio/fuel split over the complete load range is achieved.

For a staging control with different staging ratios at different load points, control valves can be implemented into the common rails allowing for an individual control of the fuel mass flow of the respective fuel injection opening groups.

One advantageous method of fuel staging is to use a preset optimized schedule to control the valves over the complete load range. The fuel split is not necessarily invariable as in the constant staging embodiment, but can change between different load points of the gas turbine engine as a function of the operating state of the burner.

Advantageously, the fuel feed is regulated such that at low load at least a first group of fuel injection openings is enriched for improved flame stability and at high load first and second fuel injection openings operate homogeneously for an optimum fuel/air mixing.

In another method the fuel feed is regulated such that at least one group of the at least first and second fuel injection openings is enriched over the complete load range, providing maximum flame stability.

According to the invention, the fuel feed can also be regulated such that fuel is supplied to only one group of the at least first and second fuel injection openings at low load. This advantageous staging concept offers the opportunity to eliminate the pilot fuel supply.

Still another and even more refined staging can be achieved with an active staging control, where the group staging is actively regulated by a logic control piloting the control valves as a function of current measured values of e.g. emissions or hardware temperature or acoustic pulsations (flame stability), to ensure optimized fuel split over the load points.

In general, fuel injection openings of different groups do not necessarily need to be neither identical nor different.

With such a fuel-air premix arrangement and such a method of operating a fuel-air premix arrangement, fuel/air mixing requirements to achieve optimum emission and flame stability at different load points and operation conditions with different compressor air velocity and different fuel velocities/mass flow are fulfilled. The injection staging of the present invention provides means to always operate the burner such that optimum emission and flame stability is achieved by adapting the correct staging to different fuel injection openings.

Furthermore, the combustor exit temperature profile is much better than in applications where (staged) groups of burners are operated within a moderate load range in two operating modes. With a fuel injection staging proposed by the present invention, all the burners are operating homogeneously, without firing temperature difference between burners as in the hot and cold groups of burners in the case, where the burners are grouped. In can combustor systems, the prior art burner grouping temperature profile variation will be even worse than in annular combustor systems, because there is no mixing between cans to even out the can to can temperature variations.

BRIEF DESCRIPTION OF THE DRAWINGS

The invention will now be further described with reference to the accompanying drawings in which.

Figure 1:
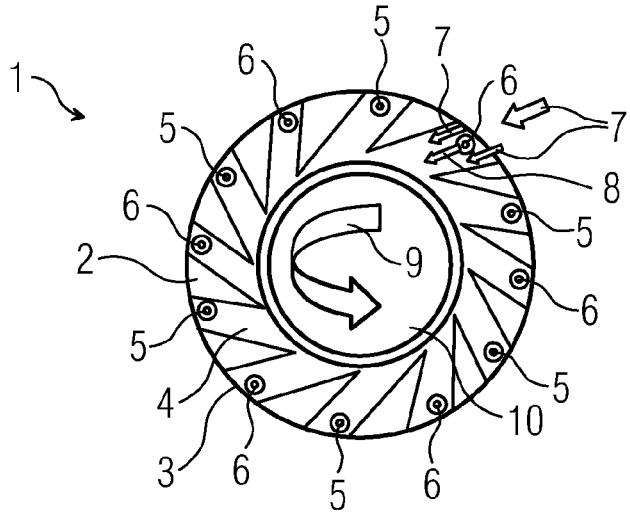
FIG. 1 represents a typical premix fuel injection system.

In the drawings like references identify like or equivalent parts.

DETAILED DESCRIPTION OF THE INVENTION

FIG. 1 illustrates a typical swirler 1 used as premix fuel injection system in a gas turbine engine. The swirler 1 comprises twelve swirler vanes 2 arranged on a swirler vane support 3. The swirler vanes 2 can be fixed to a burner head with their sides showing away from the swirler vane support 3. Neighbouring swirler vanes 2, burner head and swirler vane support 3 form swirler passages 4. Usually, fuel injection openings 5,6 are arranged in these swirler passages 4.

During operation of the burner, compressor air 7 flows into the swirler passages 4. Within the swirler passages 4 fuel 8 is injected through the fuel injection openings 5,6 into the streaming compressor air 7. The fuel/air mixture 9 then leaves the swirler passage 4 and streams through a central opening 10 of the swirler vane support 3 into a pre-chamber (not shown) and to the combustion zone, where it is burned.

In FIG. 1, the fuel injection openings 5 and 6, although identical from a design-engineering point of view, are labelled with different reference numbers, indicating their different respective group membership in the fuel-air premixing arrangement 11.

Figure 2:
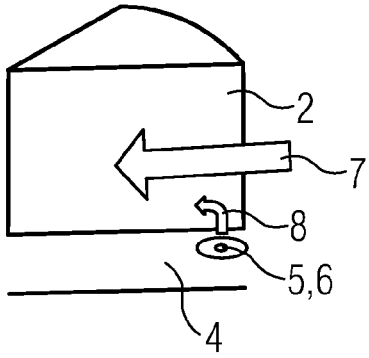
FIG. 2 represents a fuel injection system passage.

FIG. 2 shows in more detail a perspective view of a swirler passage 4 with a swirler vane 2, compressor air 7 entering the swirler passage 4, and fuel 8 entering the swirler passage 4 through a fuel injection opening 5,6 and mixing with the compressor air 7 in the swirler passage 4.

Figure 3:
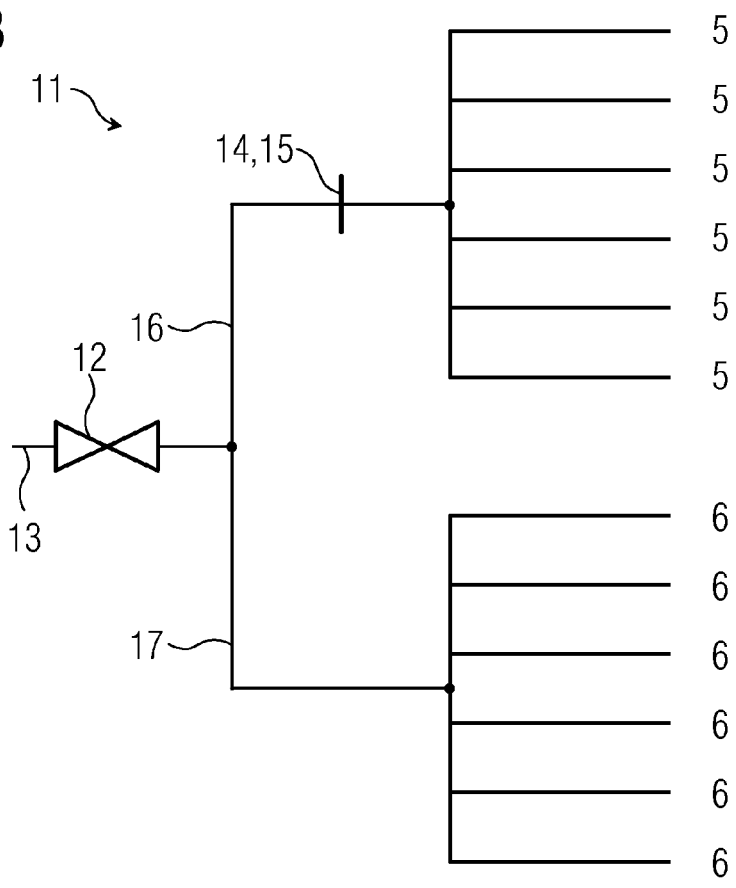
FIG. 3 is a schematic diagram for a fuel-air premixing arrangement of constant fuel staging.

With reference to FIG. 3, a schematic diagram for fuel-air premixing arrangement 11 with constant fuel staging is shown. Constant fuel staging is the easiest way of staging the fuel supply. A control valve 12 controls the fuel flow in the main fuel supply line 13. The fuel flow to the fuel injection openings 5 of the first group is constantly and over the complete load range reduced by a valve element 14, an orifice 15, which is static and arranged in the common rail 16 of the fuel injection openings 5 of the first group. The common rail 17 of the second group of fuel injection openings 6 has no orifice. Thus the fuel flow in the common rail 17 of the second group is unimpeded.

Figure 4:
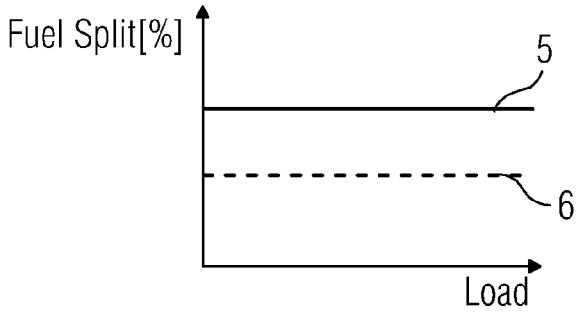
FIG. 4 represents the fuel split over load corresponding to the diagram of FIG. 3.

FIG. 4 shows the chart for the constant fuel-air premixing arrangement 11 shown in FIG. 3. The fuel split is load-independent.

Figure 5:
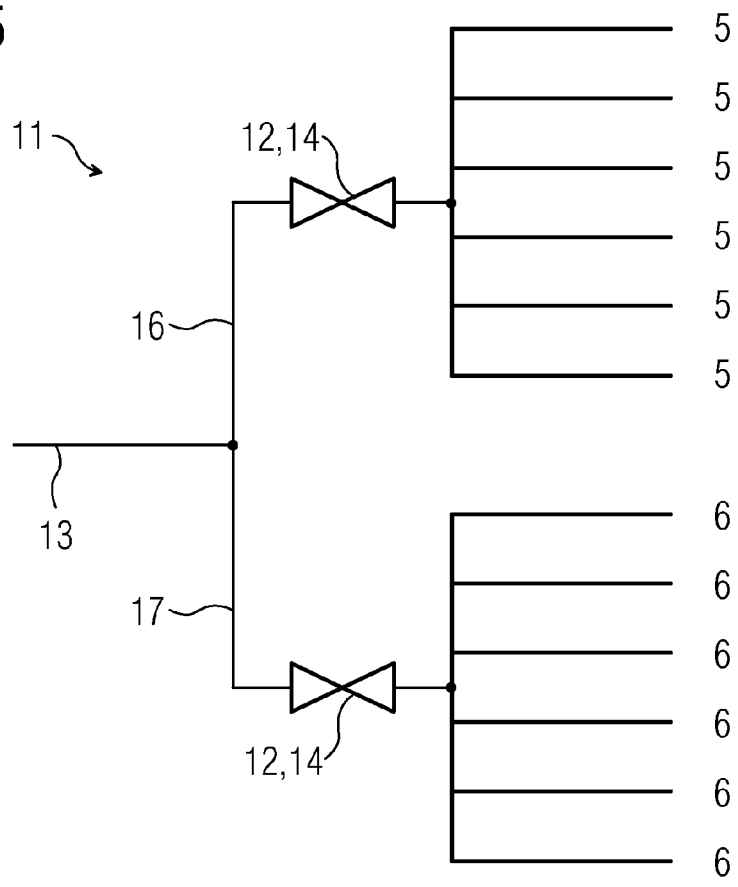
FIG. 5 is a schematic diagram for a fuel-air premixing arrangement of passive fuel staging.

With reference to FIG. 5, a schematic diagram for passive fuel staging of two groups of fuel injection openings 5,6 is shown. Valve elements 14 allowing for dynamic control, control valves 12, are arranged in the common rails 16,17 of the first and second groups of fuel injection openings 5,6, respectively. The control valves 12 allow for an individual control of fuel mass flow in the common rails 16 and 17 of the respective groups of fuel injection openings 5 and 6.

Figure 6:
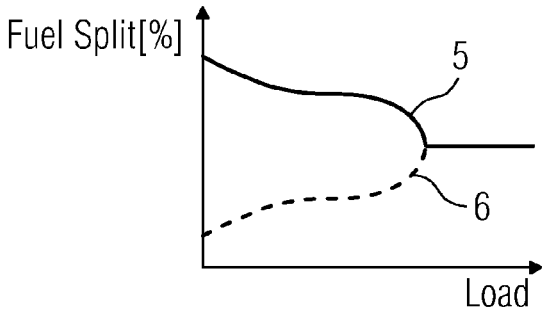
FIG. 6 represents the fuel split over load corresponding to the diagram of FIG. 5 in the case where one of the groups is enriched at low load operation and both groups are operated homogeneously at high load operation.
Figure 7:
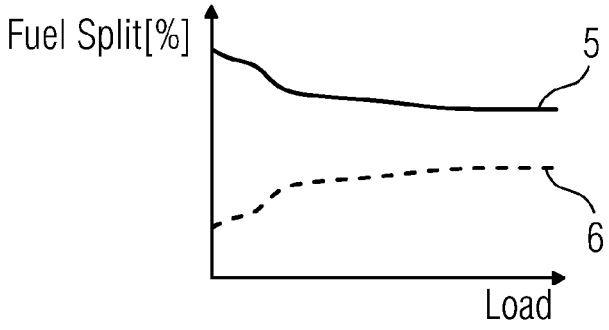
FIG. 7 represents the fuel split over load corresponding to the diagram of FIG. 5 in the case where one of the groups is enriched over the complete load range.
Figure 8:
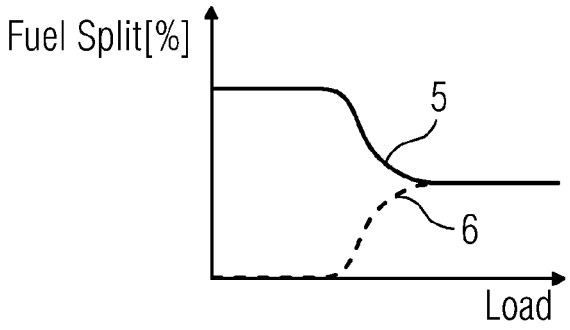
FIG. 8 represents the fuel split over load corresponding to the diagram of FIG. 5 in the case where at low load operation fuel is supplied to one group only to eliminate the pilot fuel supply.

FIGS. 6 to 8 show charts for different preset fuel splits over load corresponding to the passive fuel staging concept shown in FIG. 5. FIG. 6 illustrates the case, where one of the two groups of fuel injection openings 5 is enriched at low load operation and both groups of fuel injection openings 5,6 are operated homogeneously at high load operation.

FIG. 7 illustrates the case, where one of the groups of fuel injection openings 5 is enriched over the complete load range.

Referring to FIG. 8 the fuel split over load chart is shown, where at low load operation fuel 8 is supplied to one group of fuel injection openings 5 only, to eliminate a pilot fuel supply.

Figure 9:
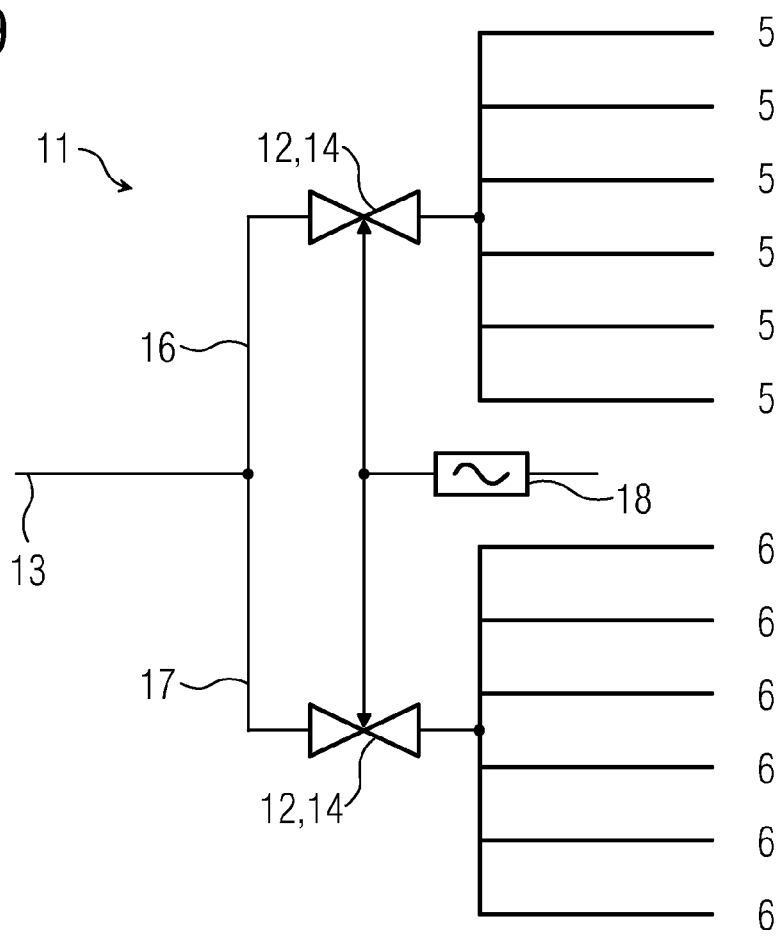
FIG. 9 is a schematic diagram for a fuel-air premixing arrangement of active fuel staging.

All three cases presented in FIGS. 6 to 8 can also be covered by an active fuel staging. FIG. 9 shows the corresponding schematic diagram. In this embodiment, the fuel split between the groups of fuel injection openings 5,6 is not preset, but adjusted by a control logic 18, taking into account current measured values of e.g. emissions, dynamics and hardware temperature.

What is claimed is:

1. A fuel-air premixing arrangement, comprising:

a plurality of fuel injection openings that are grouped into a plurality of groups and are arranged on one circle in an alternating order;

a plurality of common rails each arranged in a respective group of the groups for supplying a fuel to the respective group;

a valve element that is arranged in at least one of the common rails, wherein the plurality of groups of fuel injection openings are arranged on one circle in an alternating order on air passages that are defined between vanes of a swirler.

2. The fuel-air premixing arrangement as claimed in claim 1, wherein the common rails branch off a main fuel supply line.

3. The fuel-air premixing arrangement as claimed in claim 1, wherein the valve element is an orifice.

4. The fuel-air premixing arrangement as claimed in claim 1, wherein the valve element is a control valve.

5. The fuel-air premixing arrangement as claimed in claim 4, further comprising an active control logic for piloting the control valve.

6. A burner, comprising:

a swirler comprising a plurality of swirler vanes arranged in a circle and swirler air passages that are defined between neighboring swirler vanes, a fuel-air premixing arrangement, wherein fuel-air premixing arrangement comprises:

a plurality of fuel injection openings that are grouped into a plurality of groups and are arranged on one circle in an alternating order on the air passages of said swirler;

a plurality of common rails each arranged in a respective group of the groups for supplying a fuel to the respective group;

a valve element that is arranged in at least one of the common rails.

7. A method for operating a burner, the burner comprising a swirler having a plurality of swirler vanes arranged in a circle and swirler air passages that are defined between neighboring swirler vanes, the method comprising:

arranging a plurality of fuel injection openings in an air-fuel premixing arrangement of the burner;

grouping the fuel injection openings into a plurality of groups;

arranging the fuel injection openings on one circle in an alternating order on the air passages of said swirler;

arranging a plurality of common rails each in a respective group of the groups for supplying a fuel to the respective group;

arranging a valve element in at least one of the common rails;

feeding the fuel to the groups of the fuel injection openings; and supplying the fuel to the groups individually using the valve element.

8. The method as claimed in claim 7, wherein a fuel feed is regulated so that at a low load the fuel is supplied to at least one of the groups of the fuel injection openings and at a high load the fuel is homogeneously supplied to the groups of the fuel injection openings.

9. The method as claimed in claim 7, wherein a fuel feed is regulated so that the fuel is supplied to at least one of the groups of the fuel injection openings over a complete load range.

10. The method as claimed in claim 7, wherein a fuel feed is regulated so that the fuel is supplied to only one of the groups of the fuel injection openings at a low load.

11. The method as claimed in claim 10, wherein the fuel feed directed to the only one of the groups is used as a pilot fuel.

12. The method as claimed in claim 7, wherein a fuel split for the groups is controlled by presetting values over a load range.

13. The method as claimed in claim 7, wherein a fuel split for the groups is actively controlled based on current measured values related to operating parameters of the burner.

* * * * *